US006343979B1

(12) United States Patent
Peltier et al.

(10) Patent No.: US 6,343,979 B1
(45) Date of Patent: Feb. 5, 2002

(54) MODULAR MACHINE FOR POLISHING AND PLANING SUBSTRATES

(76) Inventors: Marc Peltier, 73 Rue Pasteur, F-38300 Bourgoin Jailleu; Lucien Grisel, Les Combes, F-38320 Herbeys, both of (FR)

( * ) Notice: Subject to any disclaimer, the term of this patent is extended or adjusted under 35 U.S.C. 154(b) by 0 days.

(21) Appl. No.: 09/646,956

(22) PCT Filed: Mar. 30, 1999

(86) PCT No.: PCT/FR99/00739

§ 371 Date: Sep. 25, 2000

§ 102(e) Date: Sep. 25, 2000

(87) PCT Pub. No.: WO99/50023

PCT Pub. Date: Oct. 7, 1999

(30) Foreign Application Priority Data

Mar. 31, 1998 (FR) ..... 98 04202

(51) Int. Cl.[7] ..... B24B 29/00
(52) U.S. Cl. ..... 451/285; 451/287; 451/443
(58) Field of Search ..... 451/285, 286, 451/287, 288, 289, 290, 443

(56) References Cited

U.S. PATENT DOCUMENTS 4,680,893 A 7/1987 Cronkhite et al.
5,562,524 A * 10/1996 Gill, Jr. ..... 451/1
5,655,954 A 8/1997 Oishi et al.
5,827,110 A * 10/1998 Yajima et al. ..... 451/5
5,893,795 A * 4/1999 Perlov et al. ..... 451/288
6,110,011 A * 8/2000 Somekh et al. ..... 451/28
6,110,024 A * 8/2000 Togawa ..... 451/285

FOREIGN PATENT DOCUMENTS

EP 0 648 575 A1 4/1995
EP 0 774 323 A2 5/1997
JP 63-207559 8/1988

* cited by examiner

*Primary Examiner*—Timothy V. Eley
*Assistant Examiner*—Dung Van Nguyen
(74) *Attorney, Agent, or Firm*—Oliff & Berridge, PLC

(57) ABSTRACT

The invention concerns a polishing machine comprising at least a base unit (10) in the form of a parallelepiped cell (12), with a first loading and unloading surface (14), a second opposite parallel surface (16) for access to the working zone located in an intermediate section (24), and third and fourth surfaces (18, 20). The loading pallet board (48) and unloading pallet board (56) are respectively borne by a loading arm (50) and an unloading arm (58) operating independently of each other, said pallet boards being both accessible on the first surface (14) side. The mechanism (28, 30) is located in the lower section beneath the cell (12) intermediate section (24), while the automaton is arranged in the top section, the mechanism and the automaton being accessible on the second surface (16) side.

14 Claims, 6 Drawing Sheets

MODULAR MACHINE FOR POLISHING AND PLANING SUBSTRATES

BACKGROUND OF THE INVENTION

The invention relates to a machine for polishing and planing substrates comprising:

- at least one rotary polishing plate on which a substrate is polished,
- a polishing head mobile in translation between a raised position and a lowered position and provided with a bearing element for support of the substrate,
- a pivoting polishing arm designed to move the polishing head to pick up the substrate to be polished from the loading pallet and to convey it onto an unloading pallet after polishing,
- at least one mechanism for driving the polishing plate and the bearing element of the polishing head in rotation, and for alternate movement of the polishing arm and of the loading and unloading pallets,
- and a controller for control of the mechanism during the polishing cycle.

STATE OF THE PRIOR ART

The document EP-A 774,323 describe a polishing machine of the kind mentioned making use of a carrousel mechanism to move the substrates onto a polishing table having a predetermined number of stations. The mechanism is located in the working zone and above the polishing table. This results in risks of pollution of the substrates in the course of polishing. Production has to be totally shut down when maintenance or tool-changing operations are performed on a given station. A carrousel machine of this kind is not extensible.

The document JP 63,207,559 describes a modular machine for grinding substrates, which are placed in cassettes and extracted by means of a loading unit which sends them to two grinding units by means of a transfer unit. After grinding, the substrate is mounted on a table of a washing unit and is stored after cleaning in cassettes of an unloading unit.

The document U.S. Pat. No. 4,680,893 refers to a machine for polishing semi-conductor substrates, having a conventional non-modular structure, equipped with a pivoting polishing arm with angular movement between a loading station, a cleaning station, a first polishing station, a second polishing station, and an unloading station.

OBJECT OF THE INVENTION

A first object of the invention is to achieve a modular polishing machine, providing easy access to the working zone in complete safety.

A second object of the invention is to provide a multi-station polishing machine of modifiable configuration, using the largest possible number of standard elements.

The polishing machine according to the invention is characterized in that the machine comprises:

- at least one base unit in the form of a parallelepipedic cubicle having a first loading and unloading surface, a second opposite parallel surface for access to the working zone situated in the intermediate compartment, and third and fourth surfaces comprising solid transverse walls extending perpendicularly to the first and second surfaces,
- the loading pallet and unloading pallet are supported respectively by a loading arm and an unloading arm with operations independent from one another, said pallets both being accessible on the side where the first surface is situated,
- the mechanism is situated in the bottom compartment underneath the intermediate compartment of the cubicle, whereas the controller of the base unit is located in the upper compartment, the mechanism being accessible on the side where the second surface is situated.

According to one feature of the invention, the polishing arm and the unloading arm are pivotally mounted around a first vertical axis. The base unit comprises a rotary conditioning head supported by a conditioning arm, which is pivotally mounted with the loading arm around a second vertical axis parallel to the first axis.

According to a preferred embodiment, a cleaning station is arranged between the two vertical axes, and between the polishing plate and the first surface of the cubicle so as to define a cleaning position of the polishing head and concentric positions of the loading and unloading pallets, and of the polishing head when substrate handling operations are performed. The mechanism comprises a geared motor housed in the bottom compartment and coupled to a rotary shaft extending in the direction of the first axis, said shaft driving a pulley and a belt-driven transmission housed in the polishing arm to move the polishing head in rotation. The rotary shaft extends inside a tubular column securedly united to the polishing arm and to an operating rod, which is controlled by a first jack to perform pivoting of the polishing arm between the cleaning station and the polishing plate. The unloading arm is securedly united to a sleeve mounted coaxially around the column with a tubular sheath interposed between the two, bearings being arranged between the sleeve and the sheath to allow a rotary movement of the unloading arm with respect to the polishing arm. An operating lever controlled by a second jack is securedly united to the sleeve to bring about the angular movement of the unloading arm.

A similar mechanism is used to actuate the conditioning and loading arm.

The complete machine, configured to the user's requirements, can present very different structures:

- single polishing module used with manual loading,
- single polishing module equipped with a loading module and an unloading module enabling work to be carried out in automatic mode on a complete wafer cassette,
- two or more juxtaposed polishing modules with wafer transfer between each module, performing a series type polishing process on the different stations constituting the equipment assembly. This assembly can be equipped with loading and unloading modules for loading from and unloading to the cassette so that it constitutes an automatic system.
- two or more juxtaposed polishing modules with a loading system by robot linking the polishing modules to a centralised loading/unloading/transfer module. This structure enables the parts to take any type of route between the different polishing modules. Each polishing module is configured on a given elementary process, and the machine control system organises the route taken by the wafers to respect the successive polishing (and measuring, if applicable) stages defined by the user. The same elementary polishing stage can be assigned to several polishing modules to optimise the overall productivity of the machine.

The polishing modules are constructed without any mechanical parts in the polishing zone to limit any risks of pollution.

BRIEF DESCRIPTION OF THE DRAWINGS

Other advantages and features of the invention will become more clearly apparent from the following description of an embodiment of the invention given as a non-restrictive example only and represented in the accompanying drawings in which.

DESCRIPTION OF A PREFERRED EMBODIMENT

Figure 1:
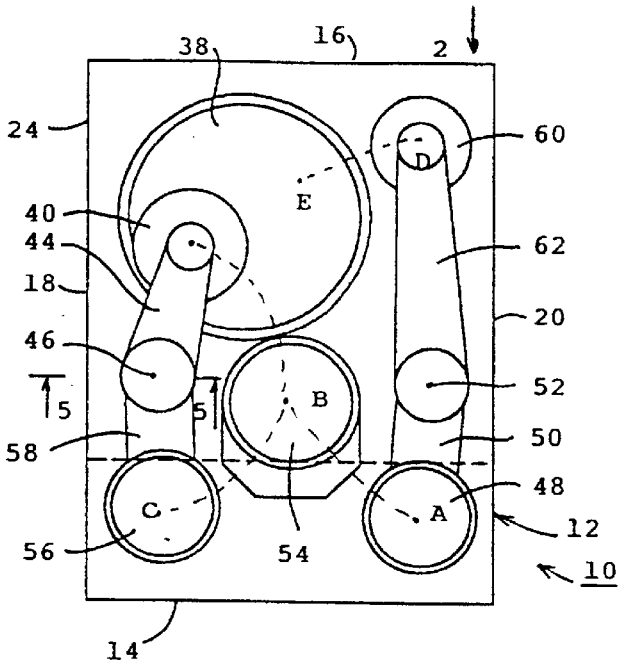
FIG. 1 is a schematic plane view of a base unit of the polishing machine according to the invention.
Figure 2:
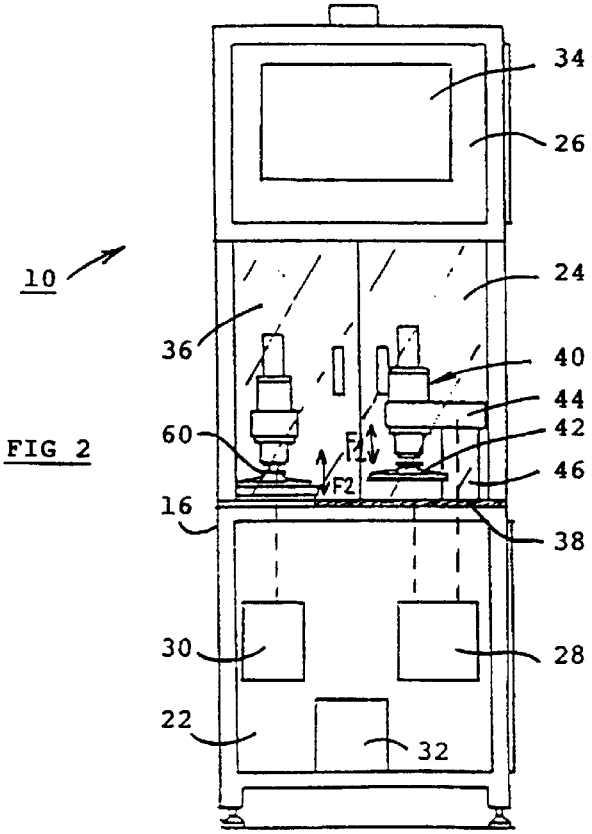
FIG. 2 shows a view according to the arrow of FIG. 1.

In FIGS. 1 and 2, a base unit 10 of a machine for polishing and planing substrates comprises a parallelepipedic cubicle 12 having a first loading and unloading surface 14, a second opposite parallel surface 16 for access to the working and control zones, and third and fourth surfaces 18, 20 formed by inaccessible solid walls perpendicular to the first and second surfaces 14, 16.

The inside of a cubicle 12 is subdivided into three superposed compartments 22, 24, 26, comprising a bottom compartment 22 housing the drive mechanisms 28, 30, an intermediate working compartment 24, and a top compartment 26 containing a controller 34 for control and monitoring of the operating cycle of the base unit 10.

The working compartment 24 is accessible from the second surface 16 via a door 36, and contains a rotary polishing plate 38 equipped on its upper surface with a tissue for receiving the liquid abrasive product. The tissue is polyurethane-based, but any other material can be used to be imbibed with the abrasive liquid. Above the polishing plate 38 which is of circular shape there is arranged a polishing head 40 provided with a bearing element 42 designed to apply a substrate on the polishing plate 38. The polishing head 40 is supported by a polishing arm 44 which is pivotally mounted around a first vertical axis 46 with a preset angular offset. The substrate bearing element 42 is animated with a rotation movement by means of a belt-driven transmission 43 integrated in the arm 44 and described in detail further on with reference to FIG. 5.

The polishing head 40 can be actuated in vertical translation in the direction of the arrow F1 between a raised position and a lowered position. In the raised position, the substrate is not in contact with the polishing plate 38 (case of FIG. 2).

Actuation of the polishing head 40 to the lowered position is achieved by means of a pneumatic or hydraulic control (not represented) operated from an energy storage means 32 housed in the bottom compartment 22. In this lowered position, the substrate presses against the polishing plate 38 and is subjected to the polishing cycle according to the parameters recorded in the controller 34. The substrate is conveyed to the polishing head 40 by means of a loading pallet 48 borne by a mobile loading arm 50 which is pivotally mounted around a second vertical axis 52 parallel to the first axis 46 and separated from the latter by a cleaning station 54. The loading arm 50 is able to occupy a loading position A of the pallet 48 and a transfer position B to the cleaning station 54.

The polishing arm 44 is also movable to the position B of the cleaning station 54 to pick up the substrate conveyed by the loading arm 50 and to put the polished substrate back at the end of the polishing cycle. The polished substrate is thus removed to an unloading pallet 56 supported by an unloading arm 58 which is articulated on the first vertical axis 46 between an unloading position C of the pallet 56 and the transfer position B to the cleaning station 54.

Regeneration of the tissue on the polishing plate 38 is performed after one or more polishing cycles by means of a rotary conditioning head 60 supported by a mobile conditioning arm 62 which is pivotally mounted around the second vertical axis 52 between a rest position D and a work position E. In the rest position D represented in FIG. 1, the conditioning head 60 is on standby outside the polishing surface. Movement to the work position E is achieved by counterclockwise pivoting of the conditioning arm 62 followed by lowering of the conditioning head 60 onto the polishing plate 38. Rotation of the conditioning head 60 removes the polishing particles which are removed to an emptying tank (not represented).

Injection of the liquid abrasive products is performed above the polishing plate 38 by means of feed ducts attached to the polishing head 40 or to the edge of the tank, and connected to a recipient in the bottom compartment 22. Solenoid valves and pumps are controlled by the controller 34 to order starting or stopping of the flow of liquid abrasive onto the polishing plate 38.

The substrates are formed for example by cylindrical semi-conductor wafers, in particular silicon-based. It is clear that the invention can apply to any other mechano-chemical polishing field.

Operation of the polishing base unit 10 is as follows:

The operator opens the doors on the side where the first surface 14 is located to place a sample on the loading pallet 48. Closing of the doors is then followed by locking of the sample on the loading pallet 48 and pivoting of the polishing arm 44 to move the head 40 to position B on the cleaning station 54. The loading arm 50 pivots around the axis 52 to the cleaning station 54 to position the loading pallet 48 under the head 40. After the sample has been unlocked from the loading pallet 48, the polishing head 40 is automatically actuated to the lowered position to grasp the sample. The head 40 then returns to the raised position, followed by return of the polishing arm 44 to the work position on the polishing plate 38. Polishing of the sample can then start after the liquid abrasive products have been injected. The loading arm 50 repositions the loading pallet 48 in position A to enable loading of the next sample.

At the end of the polishing cycle of the first sample and when rinsing on the plate 38 has been completed, the head 40 is moved to the raised position followed by movement of the polishing arm 44 to position B on the cleaning station 54. After the head has been actuated to the lowered position, the assembly formed by the polishing head 40 and the polished sample is subjected to rinsing by water jets. The head 40 then returns to the raised position and the unloading arm 58 moves the unloading pallet 56 to position B under the head 40. The sample is then deposited and locked on the unloading pallet 56 and the unloading arm 58 repositions the pallet 56 in position C.

The polishing head 40 moves downwards again to the lowered position to be cleaned in the cleaning station 54 and then returns to the raised position ready to grasp the second sample presented on the loading pallet 48 after the loading arm 50 has pivoted to position B. The rest of the process is identical to that described previously. The operation of regenerating the tissue on the plate 38 by means of the rotary conditioning head 60 can be performed during the polishing operation or when the polishing head 40 is in the cleaning station 54. The conditioning arm 62 simply has to be moved to position E to proceed with removal of the polishing particles on the plate 38.

Complementary modules can be added to the manual loading base unit 10 described with reference to FIGS. 1 and 2 to enable work to be performed in automatic mode for circulation of the substrates or samples. The different modules able to be associated to a base unit 10 are the following:

a robotized individual loading module, a robotized individual unloading module, an inter-polishing station transfer module, an integrated loading/unloading system with centralised substrate flow control.

Figure 3:
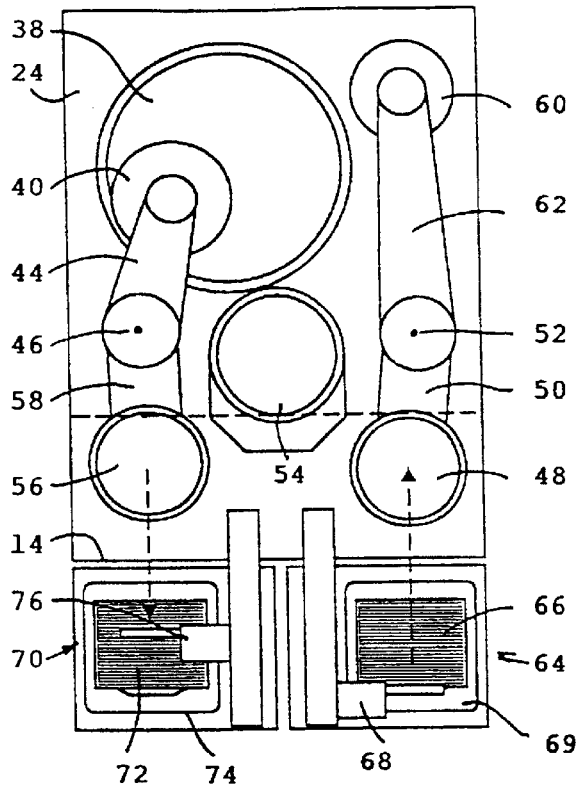
FIG. 3 represents the base unit of FIG. 1 with individual loading and unloading modules.

In FIG. 3, an individual loading module 64 is juxtaposed with the first surface 14 of the base unit 10 facing the loading pallet 48.

The module 64 comprises a loading cassette 66 containing a plurality of samples to be polished arranged in individual recesses. A handling system 68 is mounted on the fixed support 69 to extract the samples from the cassette 66 and transport them individually onto the loading pallet 48. The loading module 64 is activated by the controller 34 following a request for a sample emitted by the polishing station. The samples are disposed vertically extending parallel to the surface 14 of the base unit 10.

The operating cycle of the loading module 64 comprises the following successive stages:

movement of the handling system 68 to the sample to be polished located in a predetermined recess of the loading cassette 66, extraction of the sample and orientation of the sample so as to position the surface to be polished facing downwards, transfer of the sample to the loading pallet 48 with a translation movement perpendicular to the surface 14, depositing of the sample on the loading pallet 48, withdrawal of the handling system 68 and positioning thereof by the next sample to be polished.

An individual unloading module 70 is placed by the side of the loading module 64 facing the unloading pallet 56. The unloading module 70 is identical to the loading module 64 and comprises a receipt cassette 72 for receipt of the samples after polishing and a cassette support 74 enabling the cassette to be kept immersed. A handling system 76 identical to that 68 of the loading module 64 is designed to extract the samples from the unloading pallet 56 and to deposit them vertically in the receipt cassette 72 in the predetermined recesses extending parallel to the surface 14.

The operating cycle of the unloading module 70 comprises the following successive stages:

movement of the handling system 76 to the unloading pallet 56, extraction of a polished sample deposited on the pallet 56, transfer of the sample to the receipt cassette 72 and depositing of said cassette in a recess, movement of the handling system 76 to a standby position.

Figure 4:
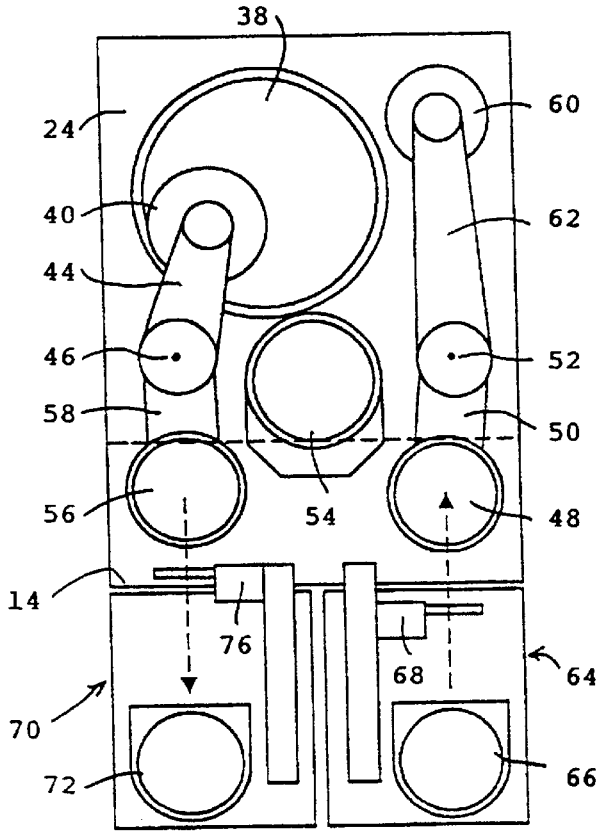
FIG. 4 shows an alternative embodiment of FIG. 3.

In the alternative embodiment of FIG. 4, instead of being arranged vertically, the samples are arranged horizontally in the respective cassettes 66, 72 of the loading and unloading modules 64, 70. Running of the operating cycles is identical to that described previously with reference to FIG. 3.

Figure 5:
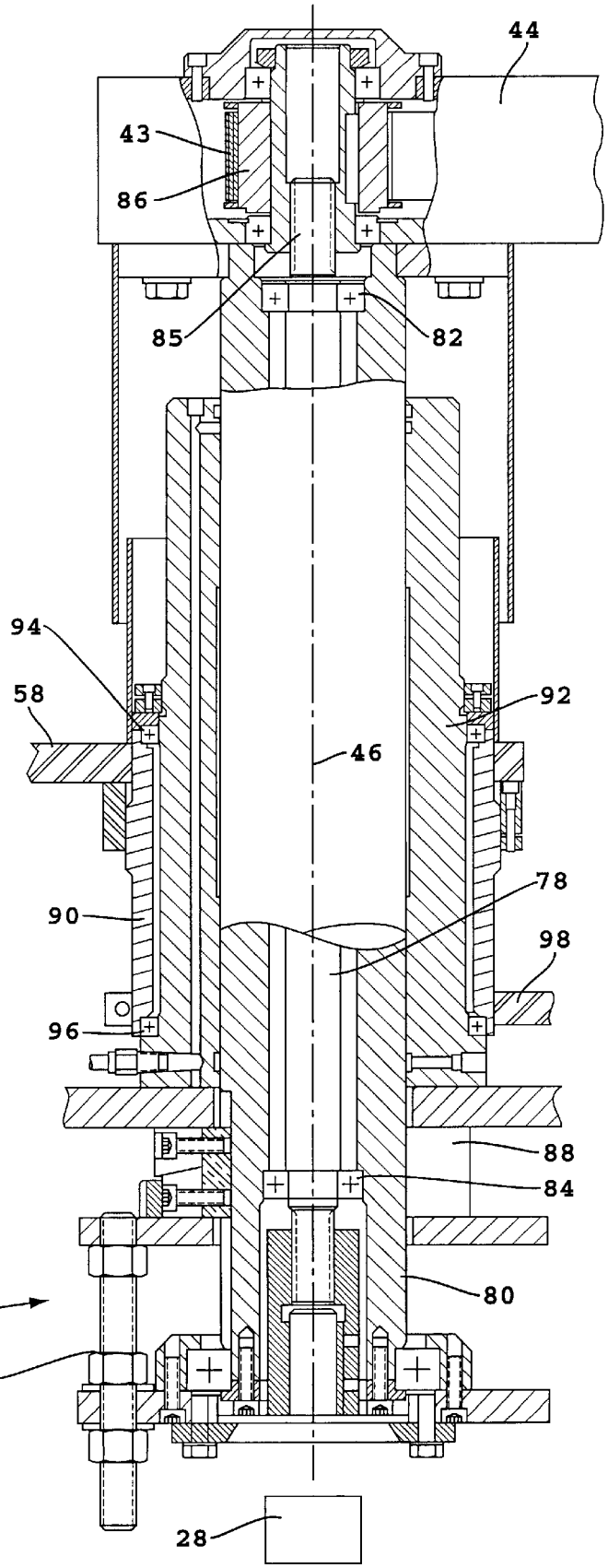
FIG. 5 is an enlarged scale cross-sectional view along the line 5—5 of FIG. 1.

In FIG. 5, the drive mechanism 28 comprises a geared motor housed in the bottom compartment 22 and mechanically coupled to a rotary shaft 78 extending along the vertical axis 46 inside a tubular column 80 securedly united to the polishing arm 44. Bearings 82, 84 are fitted between the shaft 78 and column 80, and the grooved top end 85 of the rotary shaft 78 is fixed to a pulley 86 associated to the transmission belt 43 of the polishing head 40. The belt 43 extends perpendicularly to the vertical axis 46, inside the polishing arm 44, and the column 80 rotates around the shaft 78 when pivoting of the polishing arm 44 takes place due to the action of an operating rod 88 controlled by a first jack (not represented). The unloading arm 58 is securedly united to a sleeve 90 mounted coaxially around the column 80 with a tubular sheath 92 interposed between the two. Bearings 94, 96 between the sleeve 90 and sheath 92 allow a relative pivoting movement of the unloading arm 58 with respect to the polishing arm 44. Angular movement of the unloading arm 58 is performed by means of an operating lever 98 securedly affixed to the sleeve 90 and able to be actuated by means of a second jack (not represented). Height adjustment of the polishing arm 44 is performed by an adjusting device 100 with tie rods 102.

The drive mechanism 30 with vertical axis 52 of the conditioning arm 62 and of the loading arm 50 is of the same type as that described with reference to FIG. 5.

Figure 6:
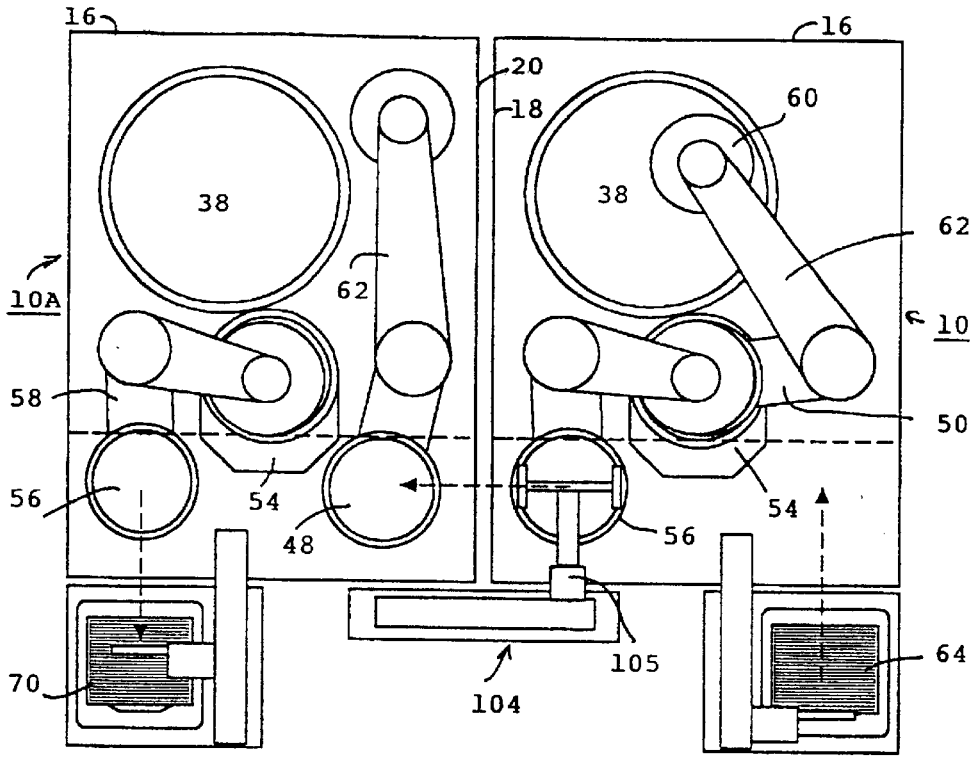
FIGS. 6 and 7 show an equipment assembly with two base units and a transfer module, respectively sliding and pivoting.

With reference to FIG. 6, an inter-station transfer module 104 operates in conjunction with two base units 10, 10A adjoined to one another by their respective faces 18, 20. A loading module 64 is associated to the base unit 10, and an unloading module 70 is associated to the adjacent base unit 10A. The transfer module 104 is intercalated in between the two modules 64, 70, and enables an operation to be performed in two stages in one and the same polishing action. The transfer module 104 comprises a slide 105 designed to move in translation to pick up a sample from the unloading pallet 56 of the unit 10 and to place it on the loading pallet 48 of the unit 10A.

Figure 7:
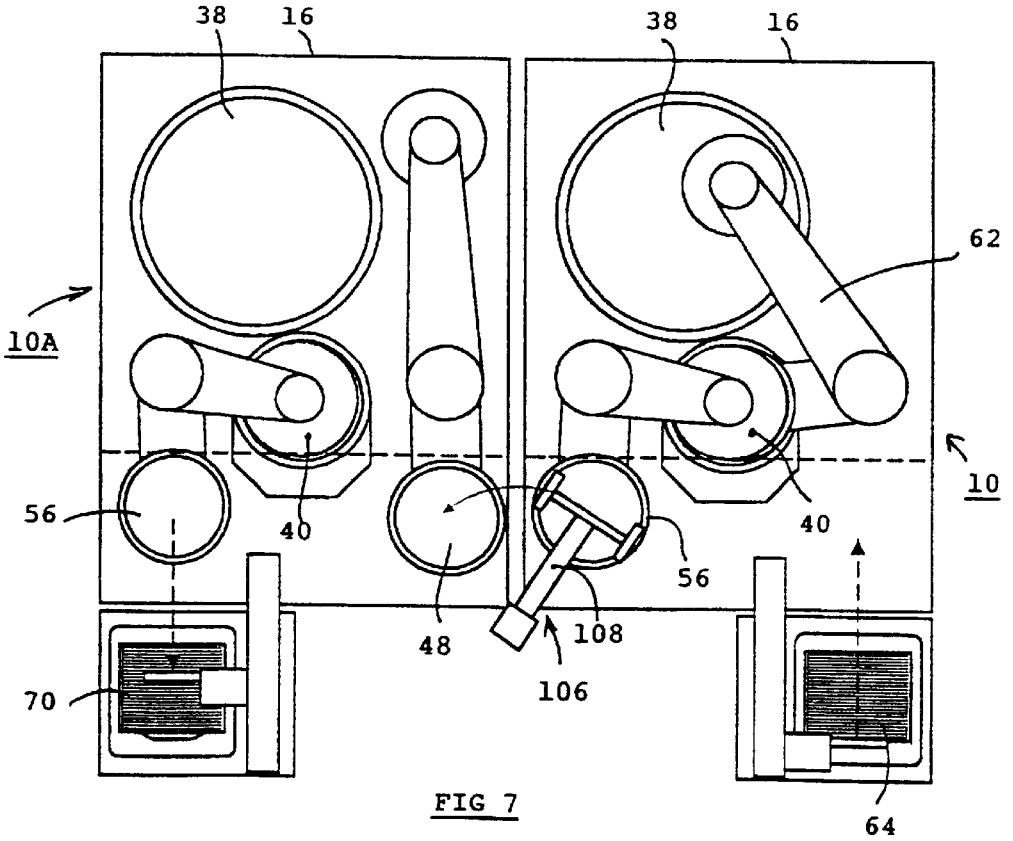

FIG. 7 shows another version of the transfer module 106 using an arm 108 pivoting between two extreme positions situated vertically above the respective pallets 56, 48 of the units 10, 10A.

Figure 8:
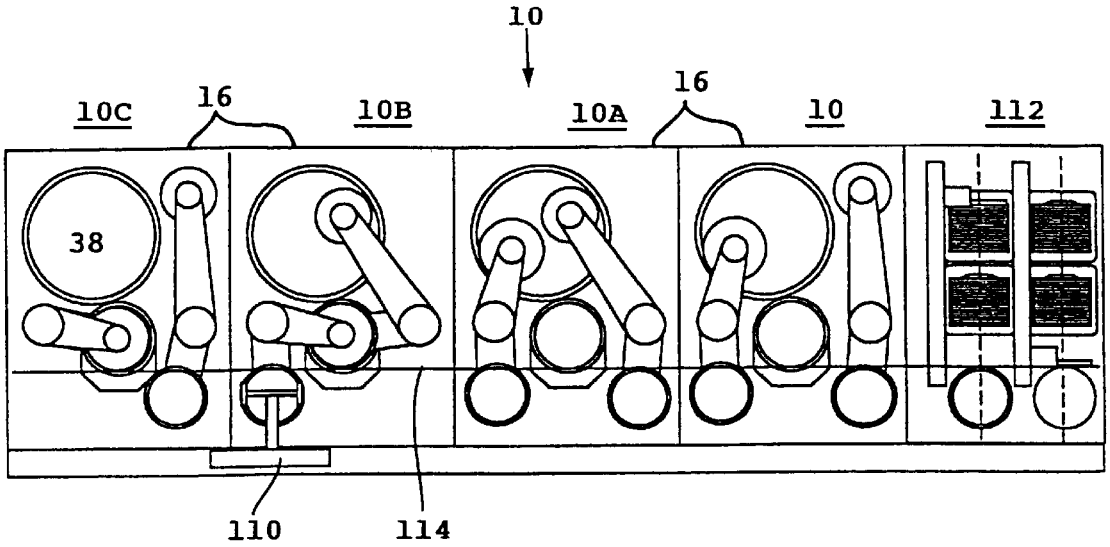
FIG. 8 represents a multi-station equipment assembly with four in-line units controlled by a robot.

FIG. 8 shows a multi-station assembly, the equipment assembly being composed of four base units 10, 10A, 10B, 10C arranged in line and operating in conjunction with a robot 110 moving in translation along the aligned surfaces 14 of the different units 10, 10A, 10B, 10C. The robot 110 provides the link between the units and a centralised loading/unloading module 112 placed in front of the base unit 10. The loading/unloading module 112 makes it possible to work with two loading cassettes and two unloading cassettes. It is possible, by means of access protections, to unload and load the set of cassettes which has been polished while the next set-is being worked on. This avoids having to wait until the machine has been completely emptied to trigger the next production batch, thus resulting in a gain in productivity.

Transportation of the samples takes place in a wet tunnel 114 with water projection to protect the samples. Each base unit 10, 10A, 10B, 10C is autonomous due to the integration of its own loading and unloading elements. The independence of the unit with respect to the transfer unit 110 means that the unit maximises its time available for polishing resulting in increased productivity.

Control of the set-up by a supervision system (not represented) enables a flexible machine configuration to be achieved. Total freedom is left in assignment of each station to a given polishing operation, and also to definition of the list of operations to be performed on each sample. Reconfiguration is automatic, when, for an event occurring during production, a polishing station becomes unavailable. In this case, the machine management organises the flow of samples to take account of this new situation and to continue production in this new context.

The mechanical structure of each station enables access to be had to the inside of a base unit previously declared to be out of order for the purpose of performing maintenance operations without this representing a risk for the person performing this operation. In particular, it is possible to change the polishing plate 38, or a polishing head 40 or conditioning head 60, while production continues on the rest of the machine. This results in an increase of the overall productivity of the installation.

Figure 9:
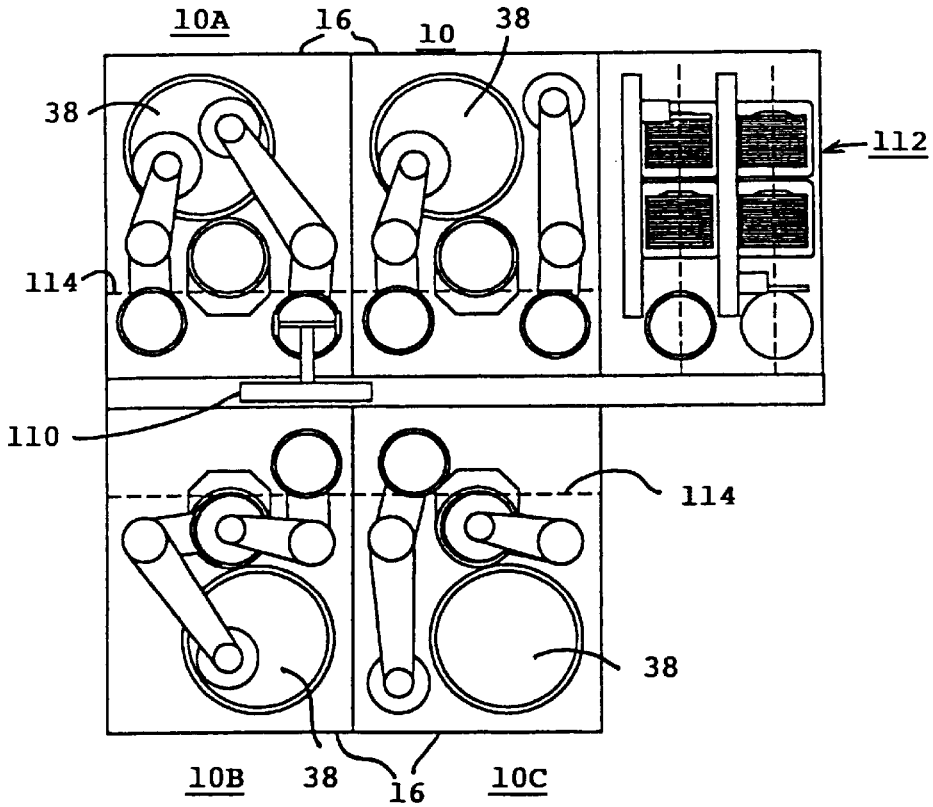
FIG. 9 is an alternative embodiment of the equipment assembly of FIG. 8.

FIG. 9 shows an alternative embodiment of a multi-station equipment assembly in which the two base units 10B, 10C are arranged facing the other two units 10, 10A with the transfer robot 110 located in the middle.

It is clear that a different number of base units can be used according to the number of samples and the polishing cycles required.

Figure 10:
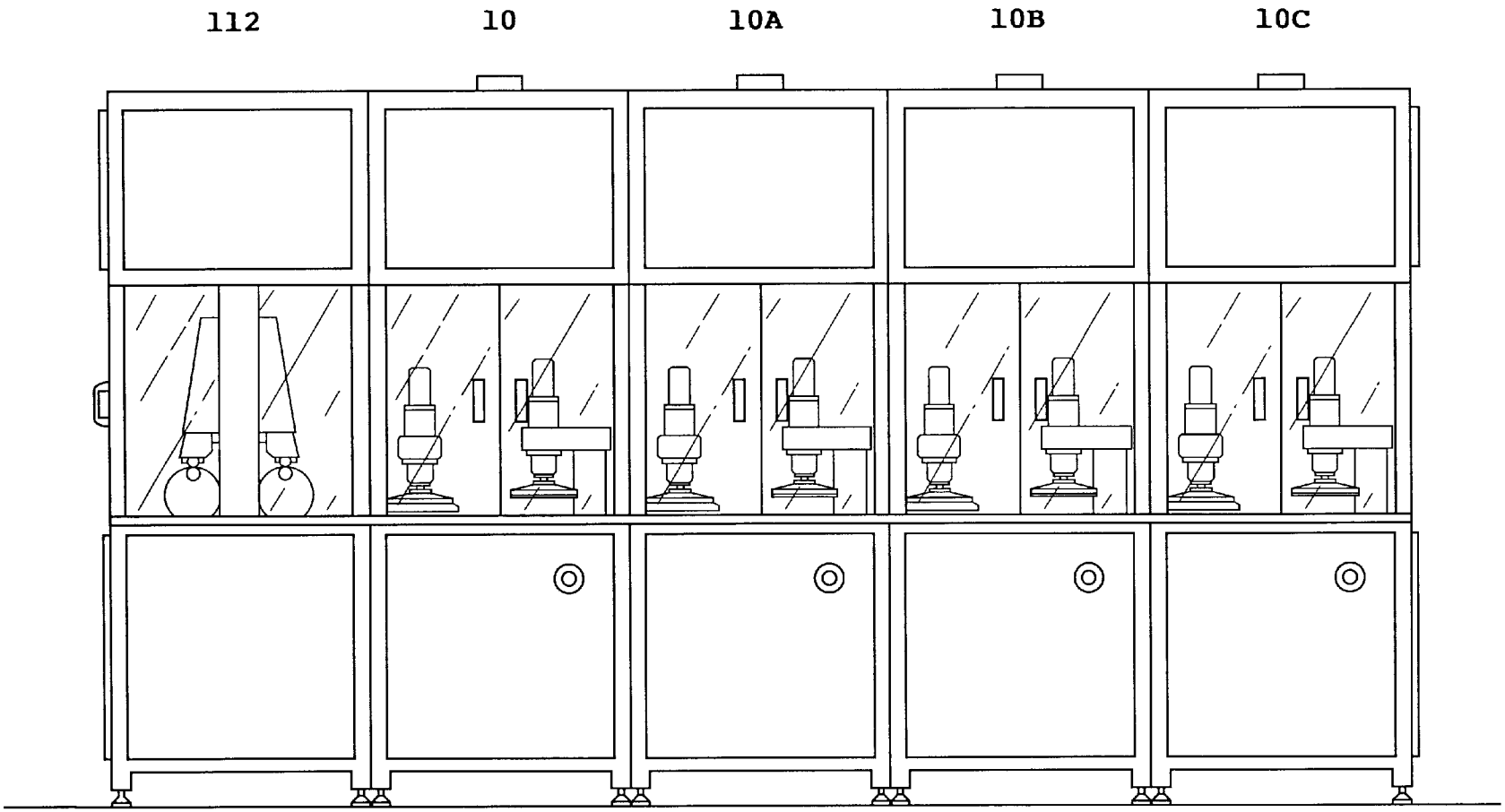
FIG. 10 is a view according to the arrow 10 of FIG. 8.

FIG. 10 represents the rear view of the multi-station equipment assembly of FIG. 8. The base units 10, 10A, 10B, 10C do not present any mechanism in the intermediate compartment where polishing takes place so as to prevent any risk of pollution. All the mechanics and the whole of the pneumatic system are integrated in the bottom compartments 22 of the units. All the handling surfaces 16 are thus accessible for changing the tools and the consumable tissue of the polishing plates 38.

What is claimed is:

1. A machine for polishing and planing substrates, comprising at least one base unit (10, 10A, 10B, 10C) in the form of a parallelepipedic cubicle (12) having a first loading and unloading surface (14), and third and fourth surfaces (18, 20) comprising solid transverse walls extending perpendicularly to the first surface (14), said base unit comprising:

at least one rotary polishing plate (38) on which a substrate is polished;

a polishing head (40) mobile in translation between a raised position and a lowered position and provided with a bearing element (42) for support of the substrate;

a pivoting polishing arm (44) designed to move the polishing head (40) to pick up the substrate to be polished from the polishing plate and to convey it onto a cleaning station;

at least one mechanism (28, 30) for driving the polishing plate and the bearing element (42) of the polishing head in rotation, and for alternate movement of the polishing arm (44) and of loading and unloading pallets (48, 56), supported respectively by a loading arm (50) and an unloading arm (58) with operations independent from one another; and a controller (34) for control of the mechanism (28, 30) during the polishing cycle, wherein a second opposite surface (16) of the base unit (10, 10A, 10B, 10C) at the opposite of the first surface (14) gives access to a working zone situated in an intermediate compartment (24), the mechanism (28, 30) is situated in a bottom compartment (22) underneath the intermediate compartment (24) of the cubicle (12) whereas the controller (34) of the base unit (10) is located in an upper compartment (26), the mechanism (28, 30) being accessible on the side where the second surface (16) is situated and the pallets (48, 56) both being accessible on the side where the first surface (14) is situated, the cleaning station (54) is arranged between the polishing plate (38) and the first surface (14) of the cubicle (12) so as to define a cleaning position of the polishing head (40) and concentric positions of the loading pallet (48) and the unloading pallet (56) and of the polishing head (40) when substrate handling operations are performed and the polishing arm (44) and the unloading arm (58) being pivotally mounted around a first vertical axis (46).

2. The polishing and planing machine according to claim 1, characterized in that the base unit (10, 10A, 10B, 10C) comprises a rotary conditioning head (60) supported by a conditioning arm (62), which is pivotally mounted with the loading arm (50) around a second vertical axis (52) parallel to the first axis (46).

3. The polishing and planing machine according to claim 1, characterized in that the mechanism (28) comprises a geared motor housed in the bottom compartment (22) and coupled to a rotary shaft (78) extending in the direction of the first axis (46), said shaft (78) driving a pulley (86) and a belt-driven transmission (43) housed in the polishing arm (44) to move the polishing head (40) in rotation.

4. The polishing and planing machine according to claim 3, characterized in that the rotary shaft (78) extends inside a tubular column (80) securedly united to the polishing arm (44) and to an operating rod (88), which is controlled by a first jack to perform pivoting of the polishing arm (44) between the cleaning station (54) and the polishing plate (38).

5. The polishing and planing machine according to claim 4, characterized in that the unloading arm (58) is securedly united to a sleeve (90) mounted coaxially around the column (80) with a tubular sheath (92) interposed, bearings (94, 96) being arranged between the sleeve (90) and the sheath (92) to allow a rotary movement of the unloading arm (58) with respect to the polishing arm (44).

6. The polishing and planing machine according to claim 5, characterized in that an operating lever (98) controlled by a second jack is securedly united to the sleeve (90) to bring about the angular movement of the unloading arm (58).

7. The polishing and planing machine according to claim 1, characterized in that an individual loading module (64) is juxtaposed with the first surface (14) of a base unit (10) facing the loading pallet (48), said module (64) having a loading cassette (66) containing a plurality of samples arranged horizontally or vertically.

8. The polishing and planing machine according to claim 1, characterized in that an individual unloading module (70) is juxtaposed with the first surface (14) of the base unit (10, 10A) facing the unloading pallet (56), said module having a receipt cassette (72) for receipt of the polished substrates, which can be arranged horizontally or vertically.

9. The polishing and planing machine according to claim 1, characterized in that an inter-station transfer module (104, 106) operates in conjunction with two base units (10, 10A) adjoined to one another by their respective transverse faces (18, 20), to perform a polishing operation in two stages after transfer from the unloading pallet (56) of one of the units (10) to the loading pallet (48) of the other unit (10A).

10. The polishing and planing machine according to claim 9, characterized in that the transfer module (104) comprises a slide (105) movable in translation between the two units (10, 10A).

11. The polishing and planing machine according to claim 9, characterized in that the transfer module (106) comprises an arm (108) pivoting between the unloading pallet (56) of the unit (10) and the loading pallet (48) of the other unit (10A).

12. The polishing and planing machine according to claim 1, characterized in that several base units (10, 10A, 10B, 10C) are associated with a loading/unloading module (112) and operate in conjunction with a programmed robot (110) moving in translation along aligned surfaces (14) of the different units, and inside a wet tunnel (114) with water projection.

13. The polishing and planing machine according to claim 12, characterized in that the base units (10, 10A, 10B, 10C) are arranged in-line.

14. The polishing and planing machine according to claim 12, characterized in that the base units (10, 10A) are arranged in tandem with other units (10B, 10C) to define an intermediate corridor for passage of the robot (110).

* * * * *